US005472569A

United States Patent [19]

Nicolucci et al.

[11] Patent Number: 5,472,569

[45] Date of Patent: Dec. 5, 1995

[54] PAPER COMPRISING CELLULOSE FIBER AND SEAWEED PARTICLES IN INTEGRAL FORM

[75] Inventors: Clemente Nicolucci, Carmignano di Brenta; Achille Monegato, Loria, both of Italy

[73] Assignee: Cartiera Favini S.p.A., Italy

[21] Appl. No.: 327,892

[22] Filed: Oct. 24, 1994

Related U.S. Application Data

[63] Continuation of Ser. No. 46,270, Apr. 14, 1993, abandoned.

[30] Foreign Application Priority Data

Apr. 16, 1992 [IT] Italy ..... VA92A0011

[51] Int. Cl.[6] ..... D01C 1/00

[52] U.S. Cl. ..... 162/99; 162/148

[58] Field of Search ..... 162/91, 99, 148

[56] References Cited

U.S. PATENT DOCUMENTS 1,509,035 9/1924 Thornley et al. ..... 162/99

1,675,244 6/1928 Blombery ..... 162/99

FOREIGN PATENT DOCUMENTS 0488486 6/1992 European Pat. Off. .

966704 10/1950 France .

363353 12/1931 United Kingdom .

508671 7/1939 United Kingdom .

*Primary Examiner*—Peter Chin

*Assistant Examiner*—Dean T. Nguyen

*Attorney, Agent, or Firm*—Parkhurst, Wendel & Rossi

[57] ABSTRACT

A process for manufacturing paper from seaweed, including the steps of washing algal material with water, draining the water from the algal material, treating the algal material with an antifermentative to prevent putrefaction, grinding the algal material to a particle size not more than 500 μm, refining the algal material in a paper refiner, mixing the algal material with cellulose fiber to form a homogenous mixture, placing the homogenous mixture in a papermaking machine to make paper. Also, the present invention relates to paper from the above-described process.

6 Claims, No Drawings

PAPER COMPRISING CELLULOSE FIBER AND SEAWEED PARTICLES IN INTEGRAL FORM

This is a continuation of application Ser. No. 08/046,270 filed Apr. 14, 1993, now abandoned.

BACKGROUND OF THE INVENTION

The present invention refers to a process for manufacturing paper having a pleasant and unique dotted pattern which readily identifies its origin, using seaweed. The following description refers especially to paper, though the process described is equally useful for the manufacture of cardboard which is therefore included as part of this invention.

One of the greatest ecological problems affecting life in enclosed or semi-closed seas, and especially in the Mediterranean and Adriatic Seas, consists of presence of huge quantities of algae. The superabundance of these organisms caused by eutrophy of the waters due to domestic, agricultural and industrial waste, creates problems for both fish and seaside tourism.

The gathering of seaweed undertaken with special boats is a method now being used to eliminate or at least reduce the quantities of algal material formed, especially near beaches and enclosed places like the lagoon of Venice. However, the algal material gathered creates the additional problem of disposal because it contains large amounts of water to make direct incineration inapplicable. Open-air drying causes fermentation and the formation of smelly gases.

Therefore, biological treatment for converting the algal material into biogas and fertilizers, or for drying it and burning it in order to obtain iodide and other mineral salts utilized in agriculture or medicines, was proposed. However, such procedures require considerable equipment and energy consumption.

The technical and scientific literature of this century contains numerous studies and patents on the use of algae as a source of fibrous material for papermaking. However, the presence of many salts in the raw seaweed together with its low fibrous material content restricted development of paper or similar products based on fibrous material of algal origin because of the expensive process needed to recover the fibrous part of algae.

A process disclosed in EP-A-488486 describes production of pulp by directly using particular types of algae belonging to the Closterium genus and to Pleurotaenium genus. Those particular types of microalgae are from sweet water and contain cellulose, large amounts of hemicellulose, no lignin, and are very different from the macroalgae which are found in the sea (salt) water.

SUMMARY OF THE INVENTION

The present invention utilizes algal material in an integral form (including dried) without the need to separate its fibrous elements, and this represents a fundamental aspect of the present invention.

Surprisingly, the non-fibrous parts of the algal material, which are basically made up of fulvic acids and polysaccharides, give improved characteristics to the cellulose fiber paper even when used in small quantities. Particularly, the use of algal material gives the paper better mechanical characteristics (resistance to bursting, stiffness and rupture length) and chemical characteristics (resistance to fats and solvents).

The integral use of algal material has an extra advantage of not producing pollutant by-products, thus circumventing the creation of further ecological problems caused by disposal. Therefore, use of algal material for manufacturing paper according to the present invention represents a particularly advantageous system for the problem of seaweed disposal.

A basic feature of the process according to the present invention lies in the fact that the algal material is reduced to particles smaller than 500 μm in size.

The algal material does not have to undergo bleaching treatment, so that the dispersion of tiny particles of algae in the paper gives the latter a unique appearance. That is, the paper may have greyish-green dots which makes its origin immediately recognizable. In fact, the presence and structure of algae is easily seen even by using an ordinary magnifying glass. This feature of paper obtained by using algal material is especially advantageous because it represents an inner marking of the paper's origin and therefore prevents its counterfeiting. This dotting also gives the paper an attractive look and its smell is that of the sea.

According to a basic feature of the present invention, the algal material gathered from the sea, and possibly washed with water or even sea water to remove the rough materials which are undesired in papermaking, is drained and treated with an antifermentative to prevent putrefaction, then ground by a suitable mill such as a colloid or ball mill to sizes of less than 500 μm. Particles larger than 500 μm are separated by sifting, preferably by a vibrating screen, and recycled in the grinding machine. The material thus prepared, which typically has a green color and preserves the seaweed smell, is placed in a cellulose fiber refiner in order to be homogenized with the cellulose fiber mixture normally used to make paper.

Typically, the antifermentative material used is an aq. solution of 1% hydrogen peroxide, but any other antifermentative material can be used, including the aqueous solutions of chlorine, of calcium and of sodium hypochlorite. The amount of algal material (calculated as dry) used may vary within very wide limits, up to a 1 to 1 weight ratio with respect to the cellulose fiber used (i.e., 50% by weight of the paper obtained).

In the preferred embodiments, the amount of algal material is regulated so as to get an 8 to 12% percentage by weight of alga (calculated as dry) in the paper obtained.

It was observed that small percentages (even just 1% alga in the final paper) of algal material placed in the mixture, according to the present invention, improve the final paper quality, in addition to allowing identification because of the unique dotting that is obtained.

DETAILED DESCRIPTION OF THE INVENTION

A more complete understanding of the present invention will be provided in relation to the following examples which are understood to be non-limiting to the basic inventive concepts of the present invention.

The algal material used in the examples consists of algae gathered from the Venice lagoon and the Mediterranean Sea, but as will appear obvious to experts in the field, any algal material can be used.

The species which are superabundant in the Venice lagoon and in the Mediterranean Sea are mainly *Ulva* (*rigida* and *lactuca*), in quantities exceeding 70%; *Enteromorpha ins-*

*estinalis* and *Gracilaria confervoides* in addition to still others which, however, are present in quantities of less than 10%.

EXAMPLE 1

1,000 Kg of algal material gathered from the Venice lagoon, mainly made up of *Ulva rigida* (more than 70% by weight), is washed directly with sea water to remove materials extraneous to the algae and entrapped in its mass, and left to drain. The algae material is then sprayed with 10 liters of 1% by vol. hydrogen peroxide solution.

The algal material is then ground in a colloid mill which reduces the size of the particles to less than 500 μm, filtered through a vibrating screen to remove the larger particles (which are sent back to the colloid mill) and sent to a paper refiner (Walley beater) for final treatment and reduction before mixing with the cellulose fiber mixture to be sent to the paper machine.

The chemical composition of the algal material used, which has is 10.1% by weight dry residue at 105° C., was as follows (all percentages refer to the dry residue):

| | |
|---|---|
| Calcium | 24.5 g/kg |
| Cobalt | 1 mg/kg |
| Iron | 997 mg/kg |
| Magnesium | 24.7 g/kg |
| Manganese | 48 mg/kg |
| Potassium | 7.4 g/kg |
| Copper | 12 mg/kg |
| Zinc | 92 mg/kg |
| Chloride | 3360 mg/kg |
| Bromide | 400 mg/kg |
| Total carbon | 34.1% |
| Organic carbon | 31.48% |
| Raw fiber | 13.8% |
| Total nitrogen | 2.59% |
| Proteic nitrogen | 2.57% |
| Total phosphorus | 1200 mg/kg |
| Hydrogen | 5.02% |
| Iodide | < 20 mg/kg |
| Sulphur | 39.5 mg/kg |
| Fulvic acid | 12.1% |

A 760 kg mixture consisting of bleached wood-pulp, 140 kg of finely ground calcium carbonate and 1,000 kg of algal material treated as above, was fed into a 700 kg/h paper machine.

A diketenic-type synthetic glue is added to the mixture to make the paper suitable for writing with aqueous inks, then cationic starch is added to increase the paper's retention powers.

The output belt speed of the machine was adjusted to 65 m/min.

The paper machine was automatically controlled by the Accuray 1180 Micro Plus system for substance, moisture and thickness.

Table 1 gives the characteristics of the paper obtained with algal material (sample B) as compared to the characteristics of paper obtained under the same operative conditions and with the same additives (glues and starch) but without algal material (sample A).

EXAMPLE 2

After washing with sea water, the same algal material used in Example 1, was dried to a fine film in a turbodryer. 100 kg of dried algal material (with a residual water content of about 5%) was ground in a ball mill and the aqueous suspension obtained was filtered through a vibrating screen to remove particles larger than 500 μm in size. 1% by weight of caustic soda in a 20% water solution was added and steam-heated to 70° C. for 20 minutes. After cooling, 1 liter of 2% by vol. hydrogen peroxide was added.

The suspension thus obtained was then cooled in the Beater machine and finally mixed with the same mixture of bleached cellulose and calcium carbonate described in Example 1.

By using the same equipment, operative conditions, cellulose and the same additives as Example 1, paper having the characteristics given in Table 1 (sample C) was obtained.

TABLE 1

| | A | B | C |
|---|---|---|---|
| grammage g/m | 84 | 83 | 84 |
| thickness micron | 98 | 110 | 105 |
| Cobb sizing wire s. g/m | 26 | 30 | 24 |
| felt s. | 27 | 32 | 26 |
| Ink Flotation (Pelikan 4001) min | 10 | 5 | >20 |
| smoothness Gurley (100 ml) sec | 200 | 150 | 200 |
| porosity Gurley (100 ml) sec | 15 | 25 | 60 |
| bursting strength kg/cm | 2.0 | 2.5 | 3.5 |
| breaking length grain d. m | 6500 | 8000 | 10000 |
| cross d. m | 3500 | 3700 | 4500 |
| wax content Dennison N | 16 | 16 | 20 |
| writing test | good | good | good |

What is claimed:

1. Paper comprising: cellulose fiber and seaweed particles, said seaweed particles comprising at least one algal material selected from the group consisting of *Ulva rigida, Ulva lactuta, Enteromorpha intestinalis* and *Gracilaria confervoides*, in an integral form, said paper having greyish-green dots due to presence of said seaweed particles and wherein the seaweed particles are present in an amount of 1–50% with respect to the weight of the paper.

2. The paper of claim 1, wherein the seaweed particles are not more than 500 μm in size.

3. The paper of claim 1, wherein the amount of said seaweed particles is 8–12 wt. %.

4. The paper of claim 1, wherein the seaweed particles comprise not less than 80% by weight *Ulva rigida* and *lactuca, Enteromorpha intestinalis* and *Gracilaria confervoides* with respect to the total weight of the seaweed particles.

5. The paper of claim 4, wherein the seaweed particles contain not less than 70% by weight of *Ulva rigida* and *lactuca* with respect to the total weight of the seaweed.

6. Paper comprising: cellulose fiber and seaweed particles, said seaweed particles comprising an algal material selected from the group consisting of *Ulva rigida, Ulva lactuta, Enteromorpha instestinalis* and *Gracilaria confervoides*, in an integral form, the paper having greyish-green dots due to presence of said seaweed particles, said paper being formed by grinding dried multi-cellular algal material to form a flour, forming a homogeneous mixture containing the flour and cellulose fiber, and forming the homogeneous mixture into the paper wherein the seaweed particles are present in an amount of 1–50% with respect to the weight of the paper.

* * * * *